United States Patent [19]

Giles et al.

[11] Patent Number: 4,949,768

[45] Date of Patent: Aug. 21, 1990

[54] LOG SURFACE HEWING PROCESS AND ASSOCIATE SURFACE HEWING MACHINE

[75] Inventors: Randy K. Giles, Jefferson County; Wolfgang Krausslich, Cocke County, both of Tenn.

[73] Assignee: Hearthstone Builders, Inc., Dandridge, Tenn.

[21] Appl. No.: 425,808

[22] Filed: Oct. 23, 1989

Related U.S. Application Data

[63] Continuation-in-part of Ser. No. 247,717, Sep. 22, 1988, Pat. No. 4,871,003.

[51] Int. Cl.[5] ..... B27L 5/02; B27C 9/00

[52] U.S. Cl. ..... 144/3 R; 144/2 R; 144/117 B; 144/134 R; 144/137; 144/358; 144/369; 144/370; 144/375

[58] Field of Search ..... 144/2 R, 3 R, 3 P, 2 D, 144/134 R, 114 R, 117 B, 367, 369, 370, 373, 358, 137

[56] References Cited

U.S. PATENT DOCUMENTS

| | | | |
|---|---|---|---|
| 3,703,198 | 11/1972 | Luebs et al. | 144/2 R |
| 3,756,295 | 9/1973 | Halop | 144/2 R |
| 3,779,294 | 12/1973 | Gillis | 144/134 R |
| 3,957,095 | 5/1976 | Johnson | 144/137 |
| 4,082,129 | 10/1978 | Morelock | 144/369 |
| 4,143,692 | 3/1979 | Traben | 144/369 |
| 4,167,961 | 9/1979 | Paris, Jr. et al. | 144/3 R |
| 4,168,675 | 9/1979 | Chisum | 144/3 R |
| 4,230,163 | 10/1980 | Barton | 144/3 R |
| 4,509,571 | 4/1985 | Peters | 144/2 R |
| 4,519,429 | 5/1985 | Dreese | 144/3 R |

*Primary Examiner*—W. Donald Bray

*Attorney, Agent, or Firm*—Pitts and Brittian

[57] ABSTRACT

A process and machine for reconfiguring the surfaces of a construction log (10) used in the construction of log structures to produce a log having the appearance of a hand-hewn log. The process includes a first step (30) of chamfering at least the upper and lower forward edge portions (22 and 24) of the log body (12) to produce upper and lower irregularly beveled forward corners (22') and 24'), and a second step (34) of cutting a plurality of indentations (38) into at least the front surface (18) of the log body (12) to produce an irregular front surface. In the third step (48) of the process, the front surface (18) of the log body (12) is scored with a plurality of cuts (54) to mimic the scoring pattern left by hand-wielded hewing tools. The hewing machine comprises a support structure including platform across which a log is moved. The machine also comprises a first cutting means supported by the support structure for chamfering at least two edge portions of the log simultaneously to produce irregularly beveled corners, and a second cutting means supported by the support structure for cutting a plurality of indentations in at least one of the surfaces of the log.

17 Claims, 10 Drawing Sheets

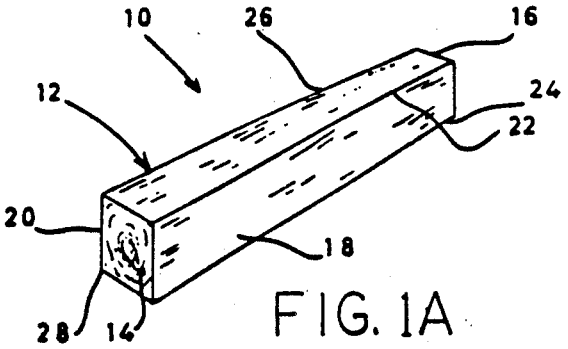
FIG. 1A
FIG. 1B
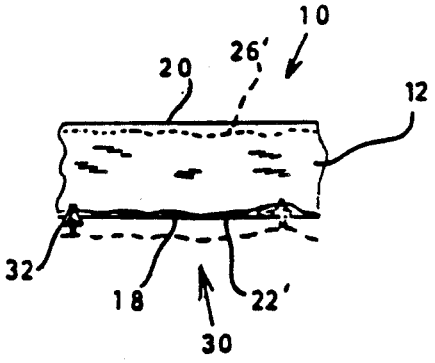
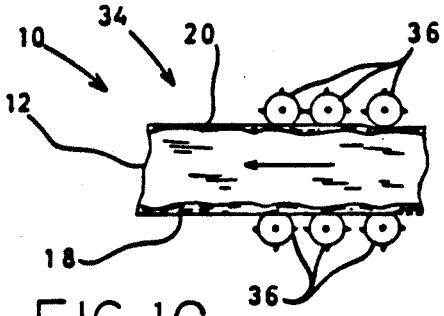
FIG. 1C
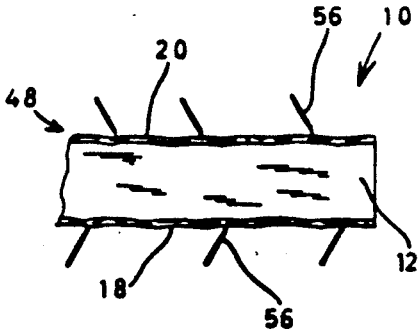
FIG. 1D
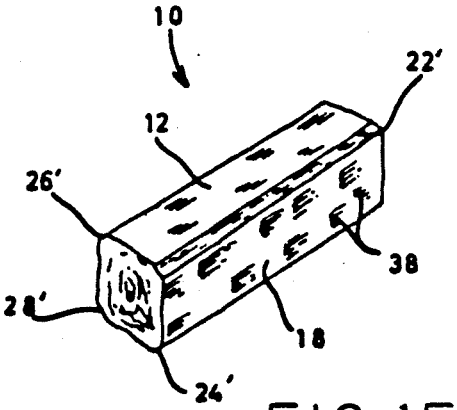
FIG. 1E

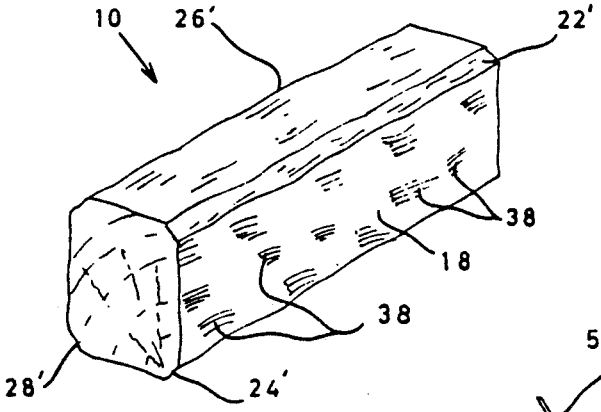
FIG. 7
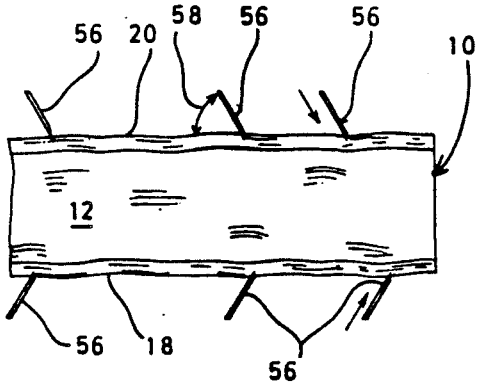
FIG. 8
FIG. 9
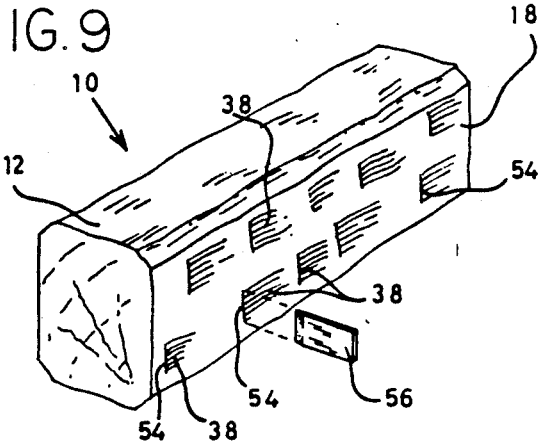
FIG. 10A
PRIOR ART
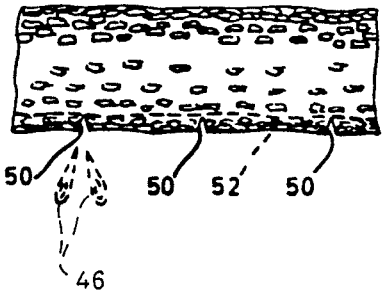
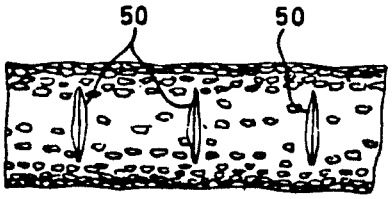
FIG. 10B
PRIOR ART

LOG SURFACE HEWING PROCESS AND ASSOCIATE SURFACE HEWING MACHINE

This is a continuation-in-part application based upon parent application Ser. No. 247,717 filed Sept. 22, 1988 now, U.S. Pat. No. 4,871,003

Technical Field

This invention relates to a log surface hewing process and machine for reconfiguring certain surfaces of a construction log used in the construction of log structures to provide a log having the appearance of a hand-hewn log. The machine generally includes a first cutting means for chamfering the edge portions of the log, and a second cutting means for cutting a plurality of selectively configured indentations into the surfaces of the log.

Background Art

In recent years, there has been a resurgence in the popularity of log homes and other log structures. However, most of the log structures built in recent years look very little like the early log structures which were constructed of hand-hewn logs, and, thus, lack the authenticity and charm of traditional log structures. This is mainly due to the fact that the logs used are produced using contemporary milling processes which result in the logs defining rectangular cross-sections and planar surfaces, rather than the irregular features of a traditionally produced hand-hewn log. In this regard, certain conventional log milling processes and devices are disclosed in U. S. Letters Pat. Nos. 3,957,095; 4,167,961; 4,168,675; 4,143,692; 4,082,129; 4,230,163; 4,509,571; and 4,519,429.

Therefore, it is an object of the present invention to provide a log surface hewing process and machine for reconfiguring the surface of a construction log used in the construction of log structures to provide a log having the appearance of a traditional hand-hewn log.

Another object of the present invention is to provide a log surface hewing process and machine for mass producing logs having a hand-hewn appearance in a quick and efficient manner.

Yet another object of the present invention is to provide a log surface hewing process which is inexpensive to use such that logs having a hand-hewn appearance can be produced at a low cost.

A further object of the present invention is to provide a log surface hewing machine which is inexpensive to manufacture and maintain.

Disclosure of the Invention

Other objects and advantages will be accomplished by the present invention which provides a log surface hewing process and machine for reconfiguring the surfaces of a construction log used in the construction of log structures to produce a log having the appearance of a hand-hewn log. The process is applied to a conventional construction log comprising an elongated body defining a substantially rectangular cross-section. The elongated body further defines oppositely disposed front and rear surfaces, longitudinally extending upper and lower forward edge portions, and longitudinally extending upper and lower rearward edge portions. The process generally comprises the steps of chamfering at least the upper and lower forward edge portions of the log body with a first power driven rotary cutting means to produce irregularly beveled upper and lower forward corners. A plurality of indentations are then cut in at least the front surface of the log body using a second power driven rotary cutting means to produce an irregular front surface. Finally, a third power driven cutting means is used to score at least the front surface of the log body to provide a plurality of laterally disposed cuts in the front surface. Resultantly, when the log is incorporated into a log structure, the irregular features produced by the irregular beveling of the edge portions, and the cutting and scoring of the forward surface, give the log the appearance of having been hand-hewn.

The hewing machine of the present invention comprises a support structure including a platform across which the log is moved during the hewing process. The machine also comprises a first cutting means supported by the support structure for chamfering at least two edge portions of the log simultaneously to produce irregularly beveled corners, and a second cutting means supported by the support structure for cutting a plurality of indentations in at least one of the surfaces of the log.

Brief Description of the Drawings

The above-mentioned steps of the present invention will become more clearly understood from the following detailed description of the invention read together with the drawings in which:

Figures 1A– E illustrate diagrammatic depictions of certain steps of the process of the present invention;

FIG. 7 is a partial perspective view of a construction log after the steps of chamfering the edge portions of the log and cutting indentations into the front and rear surfaces of the log pursuant to the process of the present invention;

FIG. 8 is a partial top view of a construction log diagrammatically illustrating the step of scoring of the front and rear surfaces of the log body pursuant to the process of the present invention;

FIG. 9 is a partial perspective view of a construction log after application of the process of the present invention;

FIG. 10A is a partial top view of a log diagrammatically illustrating the scoring of the log with hand-hewing tools in accordance with traditional log hewing methods; and FIG. 10B is a partial side elevation view of a log diagrammatically illustrating the scoring of the log with hand-hewing tools in accordance with traditional log hewing methods.

Best Mode For Carrying Out The Invention

Figure 3A:
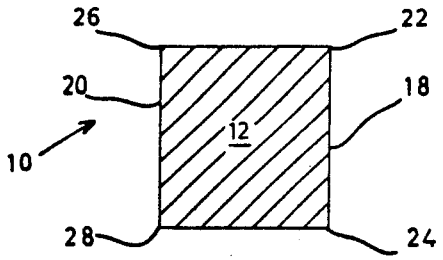
FIG. 3A is an end view, in section, of a construction log prior to application of the process of the present invention.

The various steps of the process of the present invention are diagrammatically illustrated in FIGS. 1A- -E. The process is utilized to reconfigure various surfaces of a construction log used to produce log structures such that the log gives the appearance of being hand-hewn. Of course, the use of logs having a hand-hewn appearance gives the resulting log structure the look of an authentic log structure. Prior to application the process, the construction log, illustrated at 10 in FIG. 1A, comprises an elongated body 12 defining a substantially rectangular cross-section. (See FIG. 3A) The body 12 includes first and second opposite end portions 14 and 16, respectively, and defines a longitudinal axis therebetween. The body 12 further defines a substantially planar first surface 18, a substantially planar second surface 20, longitudinally extending upper and lower forward edge portions 22 and 24, respectively, and longitudinally extending upper and lower rearward edge portions 26 and 28, respectively.

Figure 2:
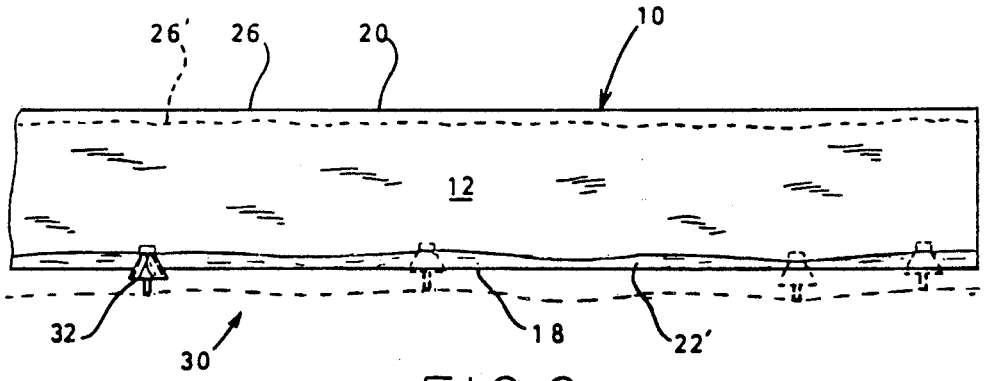
FIG. 2 illustrates a top view of a log diagrammatically illustrating the chamfering of the edge portions of the log during the application of the first step of the process of the present invention.
Figure 3B:
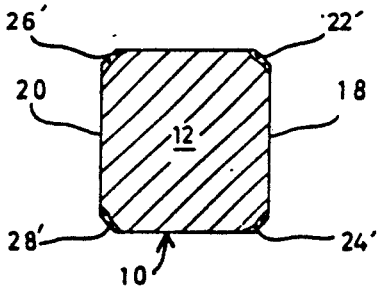
FIG. 3B is an end view, in section, of a construction log after the step of chamfering of the edge portions of the log pursuant to the process of the present invention.
Figure 4:
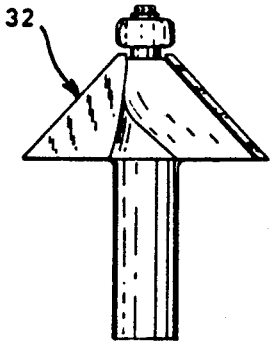
FIG. 4 is a side elevation view of one chamfering bit for chamfering the edge portions of a construction log in accordance with the process of the present invention.

Whereas, the order of the various steps of the process may vary, in the preferred application of the process of the present invention, the first step, illustrated at 30 in FIG. 1B and 2, comprises the chamfering of the edge portions 22, 24, 26 and 28 of the body 12 to remove the right angle corner defined at such edge portions. More specifically, a first power driven cutting means, which in the preferred embodiment comprises a routing device (not shown) provided with a chamfer bit 32 (see FIG. 4), is used to cut away the right angled corners, with the depth of cut of the bit 32 being selectively varied along the length of the body 12 to produce the irregularly beveled corners 22', 24', 26' and 28'. (See FIG. 3B). This irregular chamfering of the edge portions 22, 24, 26 and 28 can be accomplished by selectively reciprocating the bit 32 (and/or the router which rotates the bit 32) along its axis of rotation as the log is moved past the router in cutting contact with the bit. Resultantly, the depth of cut increases as the bit 32 is moved forward and the depth of cut decreases as the bit 32 is moved rearwardly. Of course, if desired, this step can be accomplished through travel of the first cutting means along the length of the log 10 rather than by travel of the log past the cutting means, but it will be appreciated that for purposes of mass production, it is more efficient to move the logs 10, as by a conveyor belt or device, past the cutting means. Further, it will be understood that by providing the first cutting means with a plurality of routing devices carrying the bits 32, the edge portions 22, 24, 26 and 28 can be cut simultaneously as the log 10 travels down the conveyor device It will be appreciated that the irregularly beveled corners 22', 24', 26' and 28' simulate the irregular corner surfaces which would result from the hand-hewing of the log 10 using conventional hand-manipulated cutting tools. In this regard, it will be understood that for certain applications, it may be necessary, or desirable, for only one side of the wall of a structure to depict an authentic appearance. In such situations, only the forward edge portions 22 and 24 need be chamfered so as to produce only the beveled corners 22' and 24'.

Figure 5A:
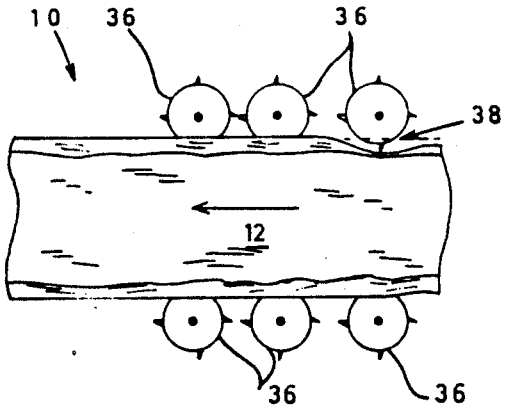
FIG. 5A is a top view of a construction log diagrammatically illustrating the step of cutting a plurality of indentations into the front and rear surfaces of such log pursuant to the process of the present invention.
Figure 5B:
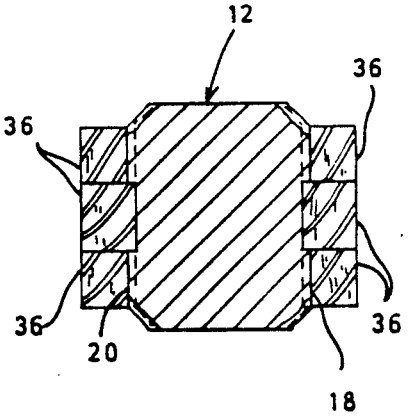
FIG. 5B is an end view of a construction log diagrammatically illustrating the step of cutting a plurality of indentations into the front and rear surfaces of the log pursuant to the process of the present invention.
Figure 5C:
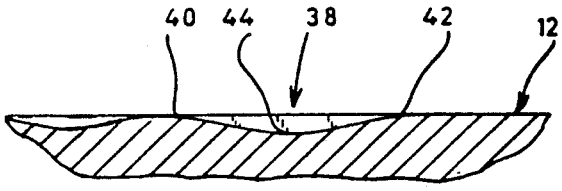
FIG. 5C is a partial top view, in section, of a construction log depicting an indentation cut in the log body in accordance wit the process of the present invention.
Figure 6A:
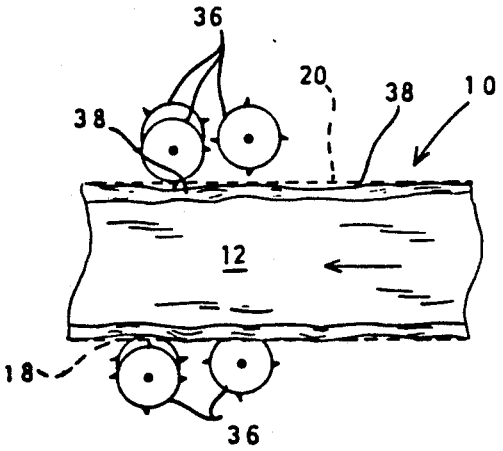
FIG. 6A is a top view of a construction log diagrammatically illustrating the step of cutting a plurality of indentations into the front and rear surfaces of the log pursuant to the process of the present invention.
Figure 6B:
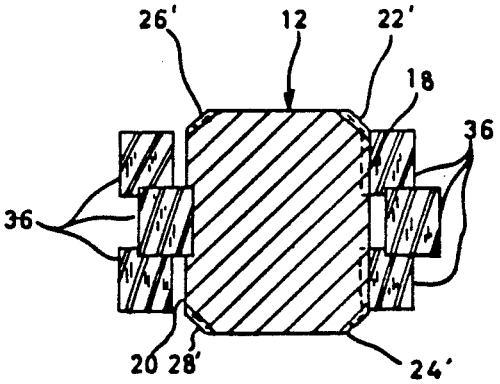
FIG. 6B is an end view of a construction log diagrammatically illustrating the step of cutting a plurality of indentations into the front and rear surfaces of the log pursuant to the process of the present invention.

The second step of the process of the present invention is illustrated at 34 in FIG. 1 and FIGS. 5A, B and C. In the second step 34, a second power driven cutting means, which, in the preferred embodiment, includes one or more rotary cutting devices (not shown) and the rotating cutting blades 36, is used to cut a plurality of concaved indentations 38 in the front and rear surfaces 18 and 20. Each of the resulting indentations 38 defines a first and second, substantially laterally disposed edges 40 and 42, respectively, and a concaved surface 44 extending substantially longitudinally therebetween such that the indentations 38 mimic the cut of a manually wielded adz, ax or similar hand-manipulated cutting tool As illustrated in FIG. 5B, in the preferred application of the process, three blades 36 are provided for each of the surfaces 18 and 20, with the blades 36 being laterally spaced with respect to the surfaces 18 and 20 such that the blades 36 cut indentations 38 at three different levels at selected intervals along the length of the surfaces 18 and 20. Of course, the blades 36 can be longitudinally spaced with respect to the log 10 (see FIG. 5A) such that as the blades 36 are simultaneously brought into cutting contact with the log 10, the resulting indentations 38 are staggered to give the visual effect of the arbitrarily positioned cuts resulting from manual hewing with a hand tool. However, an even more authentic surface pattern can be achieved by individually manipulating each blade 36, as illustrated in FIGS. 6A and B, such that the indentation pattern cut by the blades 36 is not repeated along the length of the log 10. It will also be noted that the blades 36 can be positioned to have overlapping cutting paths (see FIG. 6B) such that the indentations 38 can be made to overlap just as the manual cuts of an ax or other hand tool would overlap.

Of course, as discussed with respect to the step of chamfering the edge portions of the log 10, for certain applications it may be necessary, or desirable, to cut the indentations 38 in only one of the surfaces 18 or 20. Further, it will be understood that, whereas in the preferred application of the process three blades 36 are utilized for cutting each of the surfaces 18 and 20, the number of blades 36 utilized can vary.

FIG. 7 depicts a log 10 after steps 30 and 34 have been completed. Whereas, at this point in the process, the log 10 generally defines the irregular surface features of a hand-hewn log, the authentic appearance of the log 10 can be further enhanced by a third processing step illustrated at 48 in FIG. lD and 8. With respect to the third step 48, it will be recognized by those skilled in the art that when a log is being hand-hewn, one of the favored traditional methods for producing substantially planar surfaces is to score the log along its length with a plurality of laterally disposed scoring cuts 50 as illustrated in FIGS. 10A and B. Usually an ax 46 or adz is used to produce the cuts 50. The section of wood between the cuts 50 is then hewn away with an ax or adz to produce a substantially planar, yet irregular, surface 52. However, when the wood between the cuts 50 is removed, remnants of the scoring cuts are still visible along the length of the log. In the third step 48 of the present invention, a third power driven cutting means is used to score the surfaces 18 and 20 with a plurality of substantially laterally disposed cuts 54 which mimic the remnants of the scoring cuts 50.

In the preferred embodiment, the third cutting means comprises one or more reciprocating cutters (not shown) provided with chisel-type blades diagrammatically illustrated at 56. These blades 56 are preferably disposed at an angle other than 90 degrees relative to the axis of the log 10, and preferably disposed such that the angle 58 (see FIG. 8) is in between 50 and 70 degrees. In this regard, it had been found that where the blades 56 are disposed at an angle approximating the angle 58, the resulting cuts 54 more closely resemble the scoring marks produced by hand-hewing techniques. Further, preferably the cuts 54 are made at, or proximate, either the first edge 40 or the second edge 42 of the indentations 38. (See FIG. 9). Once again, such placement of the cuts 54 more closely mimics the surface configuration of a hand-hewn log. Of course, varying numbers of blades 56 can be used for scoring the surfaces 18 and/or 20.

Figure 11:
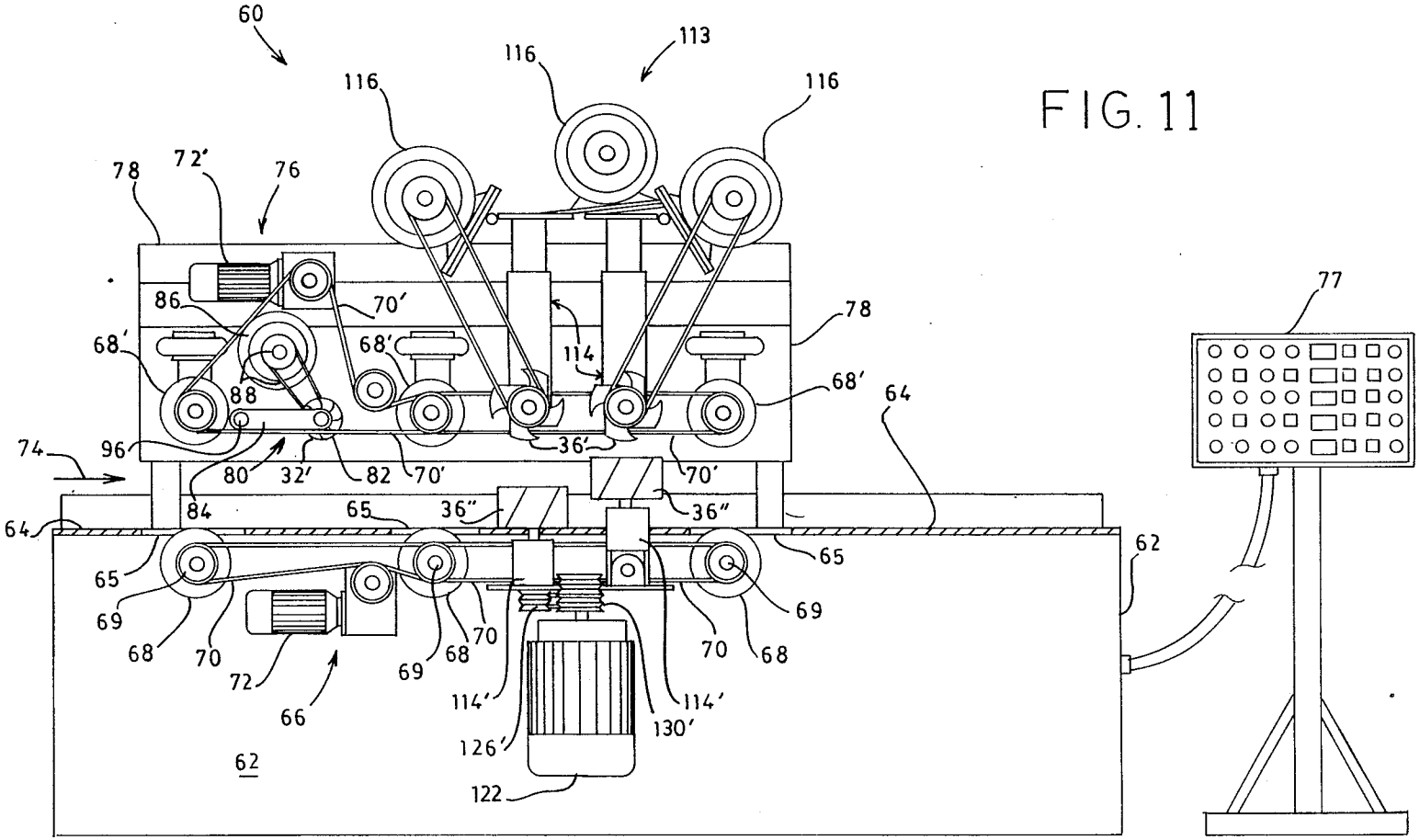
FIG. 11 illustrates a diagrammatic side elevation view of a surface hewing machine of the present invention.
Figure 12:
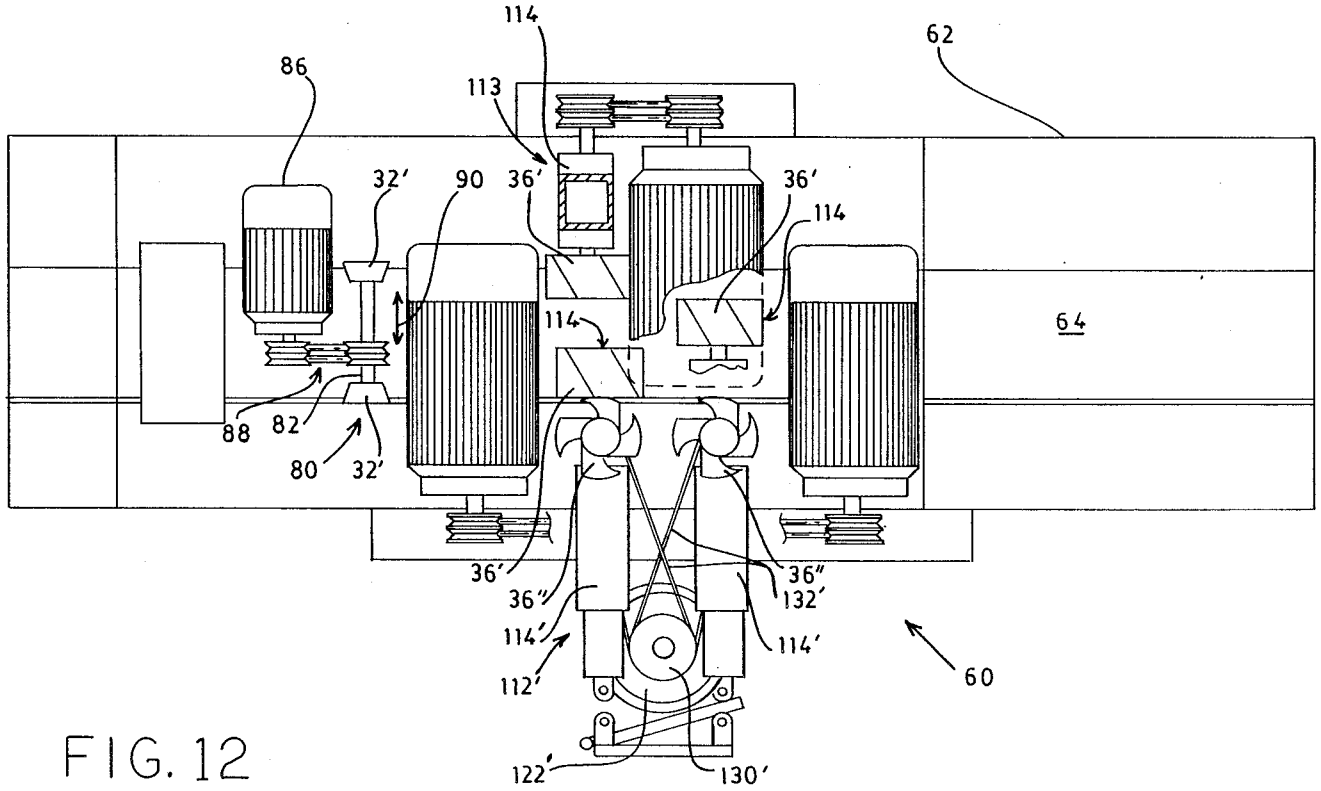
FIG. 12 illustrates a diagrammatic top view of a surface hewing machine of the present invention.

Referring now to FIGS. 11 and 12, a log surface hewing machine incorporating various features of the present invention is illustrated at 60. The machine 60 includes a lower support structure 62 having an upper work support platform 64 across which a construction log 10 is moved during the hewing process. A log feed means 66 is mounted in the lower support structure 62 for moving the log 10 across the platform 64 in the direction of arrow 74. The first log feed means 66 includes a plurality of wheel members 68 which extend through openings 65 in the platform 64 to rotatably engage the log 10. Each of the wheel members 68 is provided with a suitable sprocket 69 for receiving the endless drive belt or roller-chain 70, the chain 70 being driven by suitable motor means 72. Thus, the motor means 72 selectively rotates the wheel members 68, which, in turn, rotatably engage the log 10 and move the log across the platform 64.

As illustrated in FIG. 11, the hewing machine 60 can also be provided with a further log feed means 76 mounted on the upper support structure 78. Of course, it will be recognized that the further log feed means 76 is similar in construction to the first feed means 66. Therefore common components of the feed means 76 are referenced with common prime numerals in FIG. 11. In this regard, the wheel members 68' of the further feed means 76 engage the upper surface of the log being hewn and assist the first feed means 66 in moving the log across the platform 64. Further, it will be appreciated that by providing suitable circuitry means (not shown) the feed means 66 and 76 can be remotely controlled from a suitable control unit, such as the control unit 77 illustrated in FIG. 11.

As diagrammatically illustrated in FIGS. 11 and 12, the surface hewing machine 60 further comprises a first power driven cutting means 80 for accomplishing the simultaneous chamfering of at least two of the edge portions 22, 24, 26 and 28, in accordance with the process of the present invention. The cutting means 80 includes a pair of oppositely disposed chamfering bits 32' mounted at opposite ends of a common spindel 82. As illustrated in FIG. 11 a suitable mounting member 84 can be used for rotatably mounting the spindel 82 on the upper support structure 78. A drive motor 86 is provided for rotating the spindel 82, and, thus, the bits 32', to effect the cutting of the edge portions of the log as the log moves across the platform 64. Of course, the motor 86 is drivably connected to the spindel 82 by suitable transmission means such as the sheave and belt means generally referenced at 88.

As discussed above with respect to the process of the present invention, the depth of the cut of the bits 32' is varied along the length of the log in order to produce an irregular chamfering, thereby giving the log the appearance of a traditional hand hewn log. In the preferred embodiment this variation in depth of cut is achieved by selectively reciprocating the spindel 82 axially as indicated by the arrow 90 in FIG. 12. It will, however, be recognized that the depth of cut can also be varied by providing means for raising and lowering the bits 32' with respect to the log.

Figure 13:
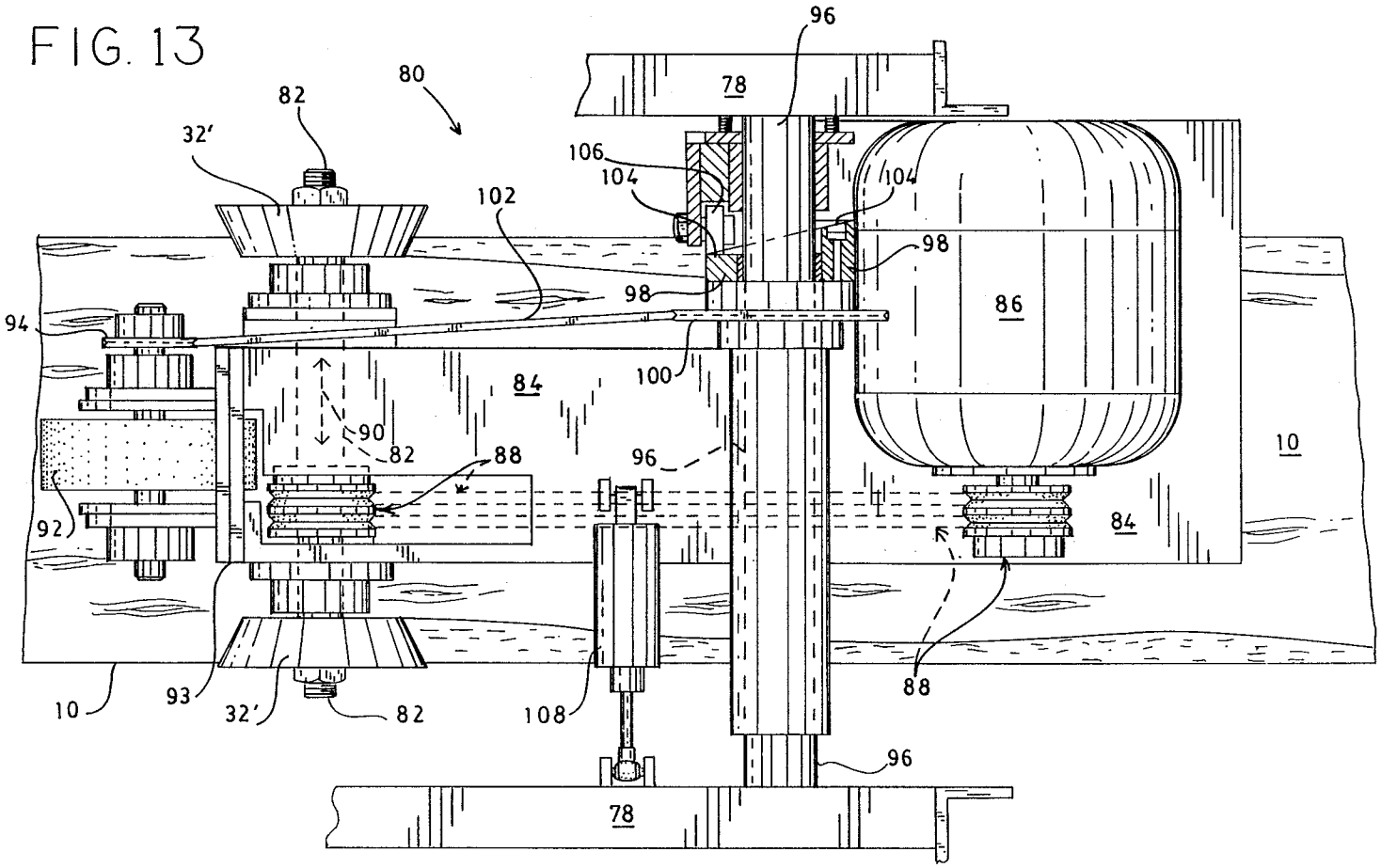
FIG. 13 illustrates a top view of the first cutting means of a surface hewing machine of the present invention.
Figure 14:
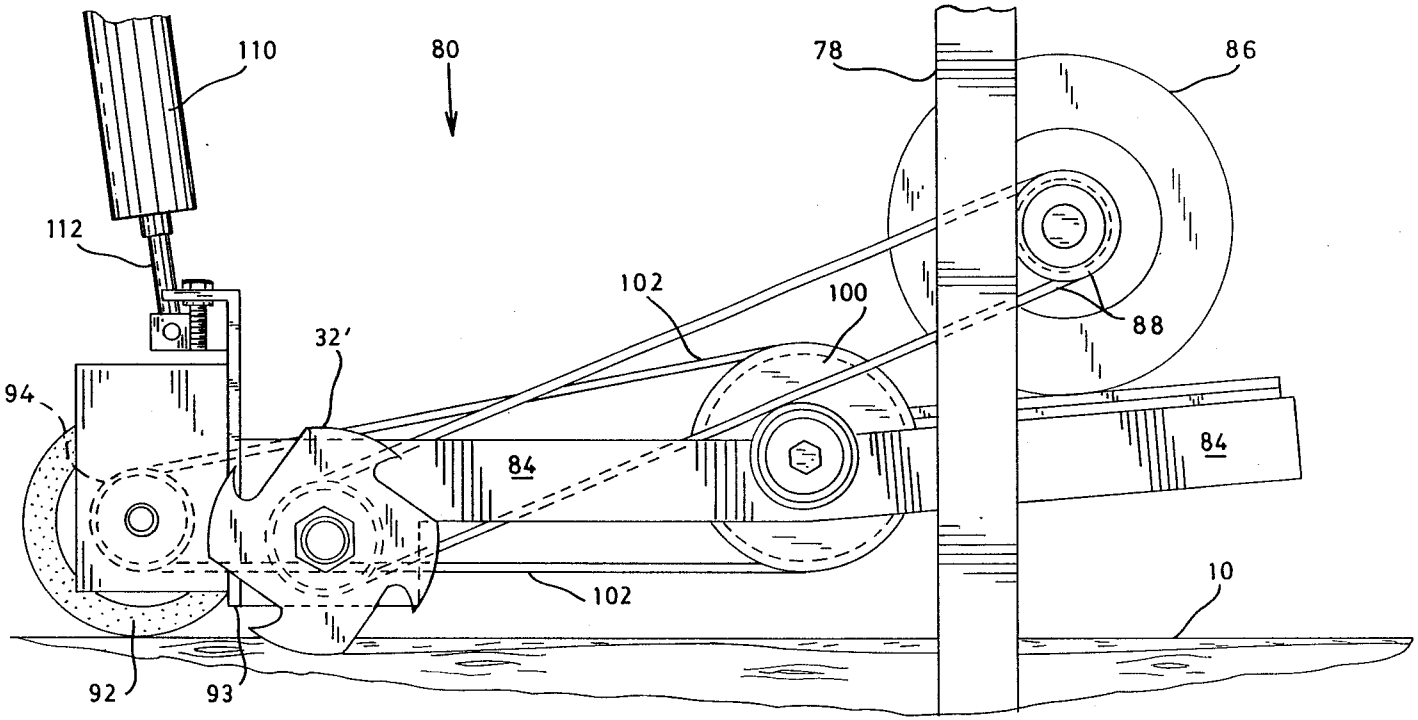
FIG. 14 illustrates a side elevation view of the first cutting means of a surface hewing machine of the present invention.

In FIGS. 13 and 14 one preferred embodiment of a first cutting means 89 is illustrated. In this preferred embodiment the movement of the log 10 across the platform 64 is utilized to reciprocate the spindel 82. In this regard, the mounting member 84 is pivotally and slidably mounted on a shaft 96 supported by the upper support structure 78, and the spindel 82 is rotatably mounted proximate the first end portion 93 of the mounting member 84. A drive wheel 92 is rotatably mounted on the first end portion 93 of the mounting member 84, along with a sprocket 94 which is disposed on a common axle, or otherwise mounted, so as to rotate with the wheel 92. As illustrated, the wheel 92 is positioned so as to engage the surface of the log 10 such that as the log moves across the platform 64 such movement rotates the wheel 92 and sprocket 94. Also, a sleeve 98, provided with a further sprocket 100, is rotatably received on the shaft 96 adjacent to the mounting member 84, and a roller chain 102 is received around the sprockets 94 and 100 such that the rotation of the wheel 92 is imparted to the sleeve 98. The outboard end of the sleeve 98 defines a cam surface 104 such that the length of the sleeve varies about this circumference. This cam surface 104 rotatably engages a cam follower 106, with the mounting member, and, thus, the cam surface 104, being biased toward the cam follower 106 by suitable biasing means such as the cylinder 108. Accordingly, it will be recognized by those skilled in the art that as the movement of the log rotates the wheel 92, the sleeve 98 is rotated and, as it rotates, the fixed position of the follower 106 forces the sleeve 98 and mounting member 84 to reciprocate axially. This axial reciprocation of the mounting member 84, of course, results in reciprocation of the bits 32' and a resulting variation in the depth of cut of the bits 32 as best illustrated in FIG. 13.

In the preferred embodiment of the first cutting means 80, means are also provided for moving the bits 32' into and out of cutting contact with the log 10. In this regard, some log configurations can require that portions of the log remain unchamfered. For example, where dove tail notches are to be cut in the end portion of a log such end portion is left unchamfered. In the illustrated embodiment of FIG. 14 the means for moving the bits 32' into and out of cutting contact with the log includes a fluid actuated cylinder 110 mounted on the upper support structure 78. The cylinder 110 has a reciprocating actuating arm 112 which engages the first end portion 93 of the mounting member 84. When retracted, the arm 112 pivots the bits 32' away from the log, and when extended pivots the bits 32' into cutting contact with the log 10. It will be understood that the reciprocation of the arm 112 can be effected through the use of various pneumatic or hydraulic systems. Moreover, automatic control means can be provided for moving the bits 32' into and out of contact with the log as the log moves across the platform 64. For example, photocells actuated by the position of the log can be used to trigger one or more solenoids or other switching means to position the bits 32' as required as the log moves across the platform 64.

It should also be noted that whereas the first cutting means 80 is illustrated as being mounted in the upper support structure 78 above the platform 64, the means 80 can be mounted in the lower support structure 62 such that the lower edges of the log are chamfered, or can be mounted in both the upper and lower support structures such that all four edges of the log are chamfered simultaneously. Moreover, the cutting means 80 can be mounted on either side of the path of travel of the log such that each of the cutting means 80 engages an upper and lower edge of the log.

The surface hewing machine 60 also comprises a second power driven cutting means 112 for cutting the indentations 38 in at least one of the surfaces of the log 10 as it moves across the platform 64. The second cutting means 112 includes two or more, and preferrably three, cutter assemblies 114, mounted on the upper support structure 78. Each of the cutter assemblies 114 includes a blade 36' driven by a motor 116, with the blades 36' being laterally spaced across the surface as illustrated in FIG. 12 and as discussed above with respect to the process of the present invention. In order to produce the indentations 38 the blades 36' are vertically reciprocated into, and out of, cutting contact with the surface of the log. Whereas this reciprocation can be produced using various blade reciprocating means, one preferred embodiment of a cutter assembly 114 with a reciprocating blade 36' is illustrated in FIG. 15 and is discussed below.

Figure 15:
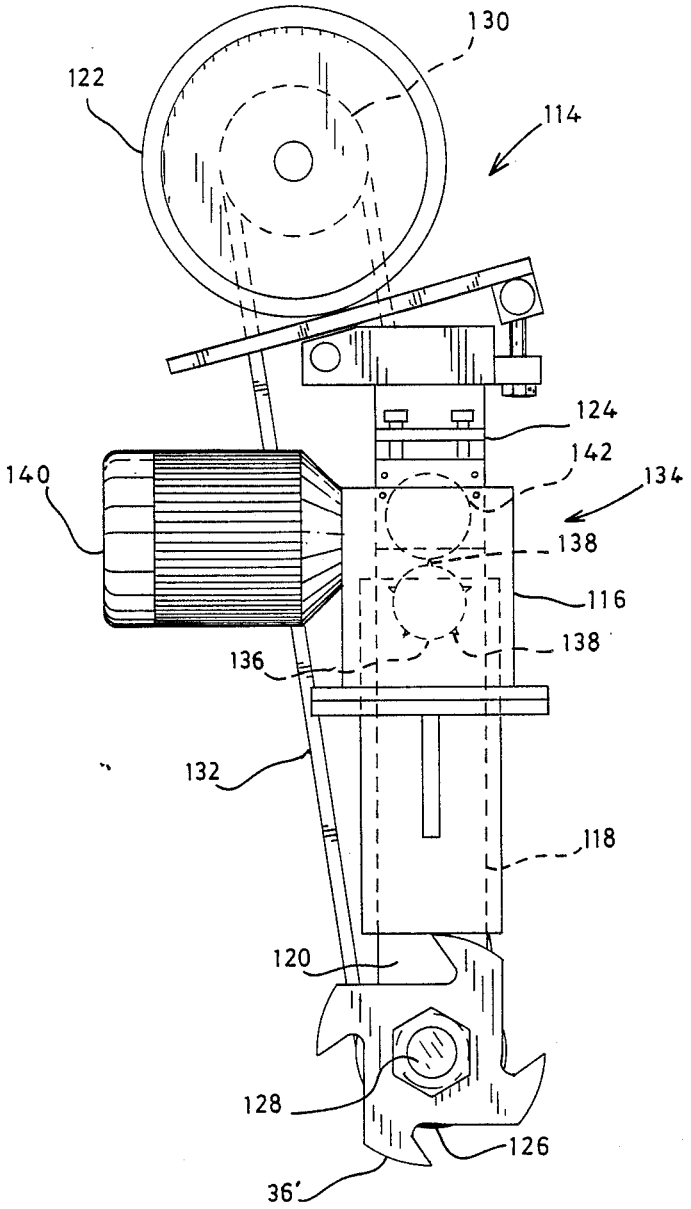
FIG. 15 illustrates a side elevation view of the second cutting means of a surface hewing machine of the present invention.

As illustrated in FIG. 15, in the preferred embodiment each cutter assembly 114 includes a housing 116 through which slidably extends an arm 118, the housing 116 being secured to the upper support structure 78. A blade 36' is rotatably mounted proximate the lower end [portion 120 of the arm 118 and a motor 122 is mounted proximate the upper end portion 124 of the arm 118 for selectively rotating the blade 36'. In order to impart the rotation of the driveshaft of the motor 122 to the blade 36' a sheave 126 is provided on the blade mounting shaft 128, and a further sheave 130 is provided on the drive shaft of the motor 122, with one or more drive belts 132 being received about the sheaves 126 and 130.

In order to vertically reciprocate the arm 118 and, thus, the blade 36', reciprocating means are provided, such means being generally referenced at 134 in FIG. 15. The reciprocating means 134 includes a wheel cam 136 mounted in the housing 116, the cam 136 being provided with selectively spaced protrusions 138 about its circumference. A motor 140, with suitable transmission means (not shown) is provided for selectively rotating the cam 136. Mounted on the arm 118 above the cam 136 is a cam following wheel 142 which engages the cam 136. Accordingly, it will be appreciated by those skilled in the art that as the cam 136 is rotated the protrusions 138 engage wheel 142 and force the arm 118, and, resultantly, the blade 36', upward, and as the cam rotates the protrusions 13 out of contact with the wheel 142 the arm 118 and blade 36' are lowered.

In this manner the blade 36' is brought into and out of contact with the log 10 to produce the indentions 38. Further, it will be recognized that by varying the spacing between the protrusions 138 of the cam 136 the indentations 38 will be cut at irregular intervals to enhance the hand hewn look of the resulting log. It will also be recognized that the hand hewn appearance of the log can be enhanced by varying the longitudinal alignment of the indentations 38 such that not all of the indentation 38 are aligned parallel to the longitudinal axis of the log. Accordingly, in the preferred embodiment of the cutter assemblies 114 a blade alignment means 144 is provided for varying the longitudinal alignment of the indentations 38 which are cut.

Figure 16:
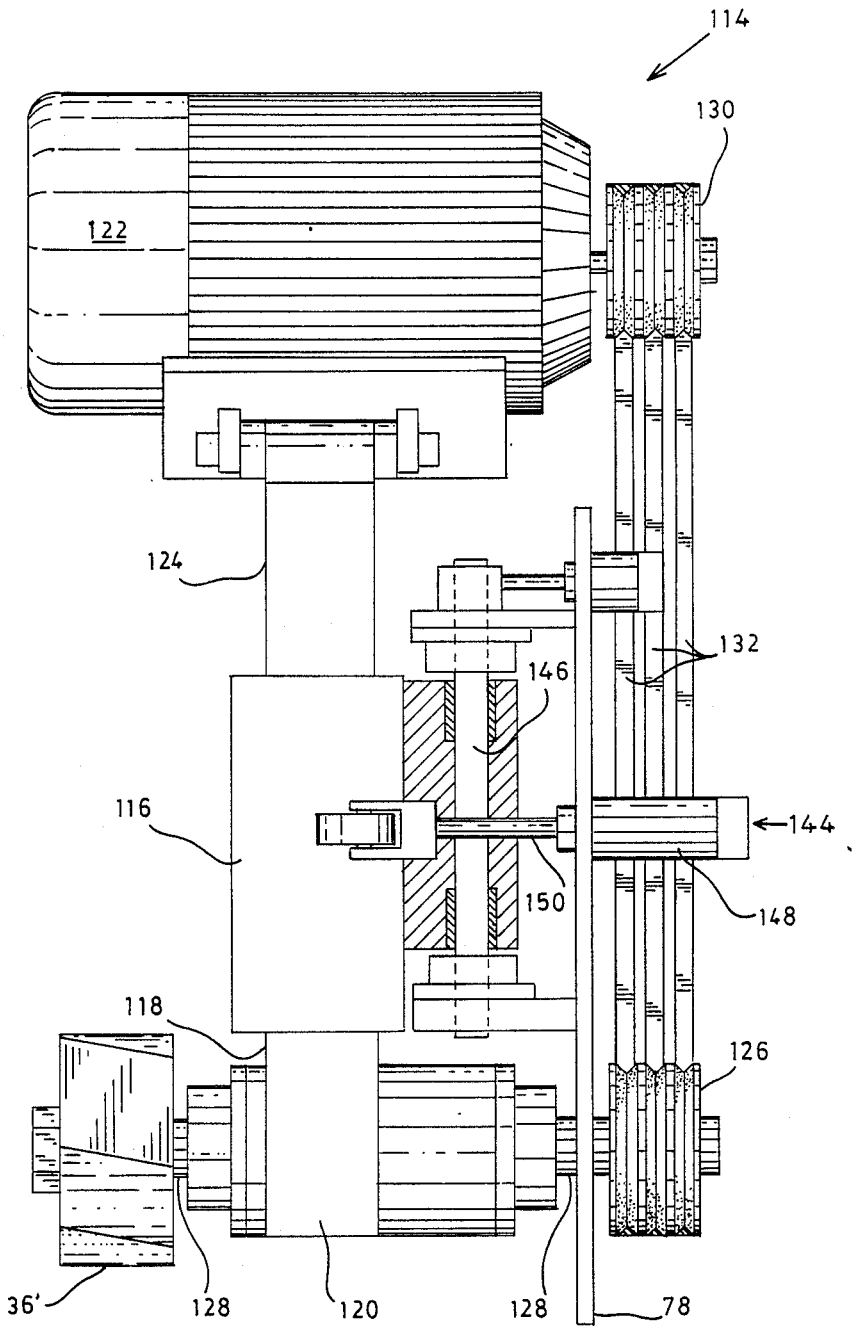
FIG. 16 illustrates an end view of the second cutting means of a surface hewing machine of the present invention.

Referring now to FIG. 16 and the blade alignment means 144, it will be noted that the housing 116 is pivotally mounted on a shaft 146 such that the entire cutter assembly 114 pivots about the axis of the shaft 146, the shaft 146, such that the entire cutter assembly 114 pivots about the axis of the shaft 146, the shaft 146 being mounted on the upper support structure 78. Further, the means 144 includes a fluid actuated cylinder 148 mounted on the upper support structure 78. The cylinder 148 has a reciprocating actuating arm 150 which engages the housing 116, and by reciprocating the actuating arm 150 the cutter assembly pivots, thus, altering the alignment of the bladed 36'. It will be understood that the reciprocation of the arm 150 can be effected through the use of various pneumatic or hydraulic systems, and automatic control means, operated from the control unit 77, can be provided to selectively vary the alignment of the blades 36' of the various cutter assemblies 114.

It will be understood by those skilled in the art that whereas the second cutting means 112 is depicted as being mounted in the upper support structure 78 for hewing the upper surface of the log, cutting means 112 can also be mounted in the lower support structure 62 for simultaneously cutting the lower surface of the log. Moreover, as illustrated in FIGS. 11 and 12 at 112', second cutting means can be provided for cutting indentions 38 in one or both of the side surfaces of a log. In the illustrated embodiment only two cutting assemblies 114' are depicted, but it will be understood that more than two assemblies 114' can be used as described above with respect to the second cutting means 112. It will also be noted that a single motor 122' rotates both cutting blades 36'', the sheave 130' serving to rotate belts 132' directed to the sheaves of both cutter assemblies 114'.

In light of the above, it will be appreciated that the process of the present invention produces a log which closely resembles a hand-hewn log when incorporated into a log structure. Moreover, the hewing machine of the present invention provides the means for efficiently accomplishing certain steps of the process. Whereas a preferred application of the process, and a preferred embodiment of the hewing machine, has been shown and described, it will be understood that there is no intent to limit the process of machine of the present invention to such disclosure, but, rather, it is intended to cover all modified and alternate applications and embodiments falling within the spirit and scope of the invention as defined in the appended claims.

I claim:

1. A log surface hewing machine for configuring the surfaces of a construction log used in the construction of log structures to produce a log having a hand-hewn appearance, said log having an elongated body defining a substantially rectangular cross-section, and including first and second end portions and a longitudinal axis extending therebetween, said body defining upper and lower surfaces and oppositely disposed front and rear surfaces, and further defining longitudinally extending upper and lower forward edge portions and longitudinally extending upper and lower rearward edge portions, said hewing machine comprising;

a support structure;

a first cutting means supported by said support structure for chamfering at least two said edge portions of said body simultaneously to produce irregularly beveled corners, said first cutting means including a pair of chamfering bits mounted on a common spindel and first motor means for selectively rotating said spindel, said first cutting means also including means for varying the depth of cut of said chamfering bits; and a second cutting means supported by said support structure for cutting a plurality of indentions in at least one of said surfaces of said body, said second cutting means including at least two cutter assemblies each having a rotatable blade and second motor means for rotating said blades of said cutter assemblies said second cutting means further including means for selectively moving said blades into cutting contact with said body.

2. The log surface hewing machine of claim 1 wherein said means for varying the depth of cut of said chamfering bits includes means for axially reciprocating said spindel, whereby said chamfering bits are reciprocated to vary the depth of cut of said bits.

3. The log surface hewing machine of claim 1 wherein said first cutting means includes means for selectively moving said chamfering blades into and out of cutting contact with said body.

4. The log surface hewing machine of claim 1 wherein said support structure includes a mounting shaft for mounting said first cutting means, and wherein said first cutting means includes a mounting member having a first end portion for rotatably supporting said spindel, said mounting shaft whereby said mounting member is laterally reciprocatable on said mounting shaft, said means for varying the depth of cut of said chamfering bits including a sleeve rotatable received on said mounting shaft, said sleeve having a first end portion for engaging said mounting member and a second end portion defining a cam surface, said means for varying the depth of cut of said chamfering bits also including a cam follower secured to said support structure said cam surface of said sleeve and means for selectively rotating said sleeve, whereby rotation of said sleeve as said cam surface engages said cam follower reciprocates said mounting member and said spindel thereby varying the depth of cut of said chamfering bits.

5. The log surface hewing machine of claim 4 wherein said means for varying the depth of cut of said chamfering bits includes means for biasing said cam surface of said sleeve toward said cam follower.

6. The log surface hewing machine of claim 1 wherein each said cutter assembly of said second cutting means includes an arm having a first end portion for rotatably supporting said blade and a housing secured to said support structure through which said arm is slidably received, and wherein said means for selectively moving said blades into cutting contact with said body includes a wheel cam rotatably mounted in said housing and defining a second cam surface having at least one protrusion and including a cam following wheel mounted on said arm for engaging said wheel cam, said means for selectively moving said blades into cutting contact also including means for selectively rotating said wheel cam, whereby said rotational engagement of said wheel cam and said cam following wheel reciprocates said arm within said housing thereby moving said blade into and out of contact with said body.

7. The log surface hewing machine of claim 1 wherein each said cutter assembly is provided with blade alignment means for varying the cutting angle of said blade operatively associated therewith, whereby the longitudinal alignment of said indentions which are cut ca[be selectively varied.

8. The log surface hewing machine of claim 6 wherein each said cutter assembly is provided with blade alignment means for varying the cutting angle of said blade operatively associated therewith, whereby the longitudinal alignment of said indentions which are cut can be selectively varied.

9. The log surface hewing machine of claim 8 wherein each said cutter assembly is pivotally mounted on said support structure so as to pivot on an axis substantially perpendicular to the rotational axis of said blade, and wherein said blade alignment means includes a[fluid actuated cylinder mounted on said support!structure having a reciprocating factuation arm for engaging and selectively pivoting said cutter assembly.

10. A log surface hewing machine for reconfiguring the surfaces of a construction log used in the construction of log structures to produce a log having a hand-hewn appearance, said log having an elongated body defining a substantially rectangular cross-section, and including first and second end portions and a longitudinal axis extending therebetween, said body defining upper and lower surfaces and oppositely disposed front and rear surfaces, and further defining longitudinally extending upper and lower forward edge portions and longitudinally extending upper and lower rearward edge portions, said hewing machine comprising;

a lower support structure including a work platform defining a plurality of openings;

an upper support structure mounted on said lower support structure above said work platform;

a first log feed means mounted in said lower support structure for moving said log across said work platform, said first log feed means including a plurality of drive wheels extending through said openings in said platform for rotatably engaging said log and including motor means for selectively rotating said drive wheels;

a first cutting means supported by said lower support structure for chamfering at least two said edge portions of said body simultaneously to produce irregularly beveled corners, said first cutting means including a pair of chamfering bits mounted on a common spindel and first motor means for selectively rotating said spindel, said first cutting means also including means for varying the depth of cut of said chamfering bits; and a second cutting means supported by said upper support structure for cutting a plurality of indentions in at least one of said surfaces of said body, said second cutting means including at least two cutter assemblies each having a rotatable blade, and second motor means for rotating said blades of said cutter assemblies, said second cutting means further including means for selectively moving said blades into cutting contact with said body, each said cutter assembly also being provided with blade alignment means for varying the cutting angle of said blade operatively associated therewith, whereby the longitudinal alignment of said indentions which are cut can be selectively varied.

11. The log surface hewing machine of claim 10 wherein said means for varying the depth of cut of said chamfering bits includesmeans for axially reciprocating said spindel, whereby said chamfering bits are reciprocated to vary the depth of cut of said bits.

12. The log surface hewing machine of claim 11 wherein said first cutting means includes means for selectively moving said chamfering blades into and out of cutting contact with said body.

13. The log surface hewing machine of claim 12 wherein said support structure includes a mounting shaft for mounting said first cutting means, and wherein said first cutting means includes a mounting member having a first end portion for rotatably supporting said spindel, said mounting member being slidably secured to said mounting shaft whereby said mounting member is laterally reciprocatable on said mounting shaft, said means for varying the depth of cut of said chamfering bits including a sleeve rotatably received on said mounting shaft, said sleeve having a first end portion for engaging said mounting member and a second end portion defining a cam surface, said means for varying the depth of cut of said chamfering bits also including a cam follower secured to said support structure for engaging said cam surface of said sleeve and means for selectively rotating said sleeve, whereby rotation of said sleeve as said cam surface engages said cam follower reciprocates said mounting member and said spindel thereby varying the depth of cut of said chamfering bits.

14. The log surface hewing machine of claim 13 wherein said means for varying the depth of cut of said chamfering bits includesmeans for biasing said cam surface of said sleeve toward said cam follower.

15. The log surface hewing machine of claim 14 wherein each said cutter assembly of said second cutting means includes an arm having a first end portion for rotatably supporting said blade and a housing secured to said support structure through which said arm is slidably received, and wherein said means for selectively moving said blades into cutting contact with said body includes a wheel cam rotatably mounted in said housing and defining a second cam surface having at least one protrusion and includes a cam following wheel mounted on said arm for engaging said wheel cam, said means for selectively moving said blades into cutting contact also including means for selectively rotating said wheel cam, whereby said rotational engagement of said wheel cam and said cam following wheel reciprocates said arm within said housing thereby moving said blade into and out of contact with said body.

16. The log surface hewing machine of claim 15 wherein each said cutter assembly is pivotally mounted on said support structure so as to pivot on an axis substantially perpendicular to the rotational axis of said blade, and wherein said blade alignment means includes a fluid actuated cylinder mounted on said support structure and having a reciprocative actuation arm for engaging and selectively pivoting said cutter assembly.

17. The log surface hewing machine of claim 16 wherein said machine further comprises a second log feed means mounted in said upper support structure, said second log feed means including a plurality of further drive wheels for rotatably engaging said log and motor means for selectively rotating said further drive wheels.

* * * * *